US010426218B2

(12) United States Patent
Harvey

(10) Patent No.: US 10,426,218 B2
(45) Date of Patent: Oct. 1, 2019

(54) RETRACTABLE HIGH HEEL SHOE

(71) Applicant: Shirley Harvey, Richmond, VA (US)

(72) Inventor: Shirley Harvey, Richmond, VA (US)

( * ) Notice: Subject to any disclaimer, the term of this patent is extended or adjusted under 35 U.S.C. 154(b) by 0 days.

(21) Appl. No.: 15/659,129

(22) Filed: Jul. 25, 2017

(65) Prior Publication Data

US 2018/0020765 A1 Jan. 25, 2018

Related U.S. Application Data

(60) Provisional application No. 62/366,414, filed on Jul. 25, 2016.

(51) Int. Cl.

| | |
|---|---|
| ***A43B 3/24*** | (2006.01) |
| ***A43B 21/24*** | (2006.01) |
| ***A43B 1/00*** | (2006.01) |
| ***A43B 13/22*** | (2006.01) |
| ***A43B 13/04*** | (2006.01) |
| ***A43B 7/38*** | (2006.01) |
| ***A43B 21/42*** | (2006.01) |
| ***A43B 21/437*** | (2006.01) |

(52) U.S. Cl.

CPC ..... *A43B 3/24* (2013.01); *A43B 1/0054* (2013.01); *A43B 1/0063* (2013.01); *A43B 3/246* (2013.01); *A43B 7/38* (2013.01); *A43B 13/04* (2013.01); *A43B 13/22* (2013.01); *A43B 21/24* (2013.01); *A43B 21/42* (2013.01); *A43B 21/437* (2013.01)

(58) Field of Classification Search

CPC ..... A43B 1/0054; A43B 3/24; A43B 3/246; A43B 3/248; A43B 21/42; A43B 21/51

USPC ..... 36/42, 15, 100, 81

See application file for complete search history.

(56) References Cited

U.S. PATENT DOCUMENTS

| | | | | | |
|---|---|---|---|---|---|
| 2,301,702 | A * | 11/1942 | Ernest | A43B 7/38 | 36/81 |
| 2,707,341 | A * | 5/1955 | Romano | A43B 13/34 | 36/100 |
| 3,079,709 | A * | 3/1963 | Kiril | A43B 21/48 | 36/42 |
| 3,805,418 | A * | 4/1974 | Matuka | A43B 21/30 | 36/34 A |
| 4,062,132 | A * | 12/1977 | Klimaszewski | A43B 3/24 | 36/100 |
| 4,416,072 | A * | 11/1983 | Sarkissian | A43B 3/24 | 36/100 |
| 5,477,625 | A * | 12/1995 | Goldsmith | A43B 1/0054 | 36/100 |
| 5,887,360 | A * | 3/1999 | Bucalo | A43B 3/24 | 36/100 |
| 6,021,586 | A * | 2/2000 | Bucalo | A43B 3/24 | 36/42 |
| 6,578,289 | B1 * | 6/2003 | Bucalo | A43B 21/51 | 36/100 |
| 6,785,987 | B2 * | 9/2004 | Bucalo | A43B 21/51 | 36/100 |

(Continued)

*Primary Examiner* — Marie D Bays

(74) *Attorney, Agent, or Firm* — Global Intellectual Property Agency, LLC; Daniel Boudwin

(57) ABSTRACT

A retractable high heel shoe. The retractable high heel shoe includes a shoe having an upper portion extending perpendicularly upwards from a sole defining an interior volume that can receive a foot therein. A heel having a lower side is affixed to the sole at a rear side of the shoe. The heel includes a plurality of sections that can telescopically move between an extended position and a retracted position.

15 Claims, 4 Drawing Sheets

(56) References Cited

U.S. PATENT DOCUMENTS

| | | | | |
|---|---|---|---|---|
| 8,453,351 | B1 * | 6/2013 | Hale | A43B 21/437 36/100 |
| 2002/0144436 | A1 * | 10/2002 | Magallanes | A43B 21/42 36/100 |
| 2006/0075662 | A1 * | 4/2006 | Schupbach | A43B 3/24 36/100 |
| 2012/0055048 | A1 * | 3/2012 | Haupt | A43B 3/24 36/34 R |
| 2012/0174435 | A1 * | 7/2012 | Ruano | A43B 1/0054 36/42 |
| 2015/0113837 | A1 * | 4/2015 | Isinhue | A43B 21/42 36/34 R |
| 2015/0157087 | A1 * | 6/2015 | Blumenthal | A43B 21/42 36/100 |
| 2018/0020765 | A1 * | 1/2018 | Harvey | A43B 7/38 36/100 |

* cited by examiner

RETRACTABLE HIGH HEEL SHOE

CROSS REFERENCE TO RELATED APPLICATIONS

This application claims the benefit of U.S. Provisional Application No. 62/366,414 filed on Jul. 25, 2016. The above identified patent application is herein incorporated by reference in its entirety to provide continuity of disclosure.

BACKGROUND OF THE INVENTION

The present invention relates to high heel shoes. More particularly, the present invention relates to high heel shoes having a retractable heel configured to extend and retract between an extended position and a retracted position.

Many people wear high heel shoes. However, those that do need to frequently change their footwear between various types throughout the day, such as high heels, flats, sneakers, and the like. Frequent changes can be inconvenient and frustrating, as multiple pairs of footwear need to be carried throughout the day. Some people opt to instead wear high heels through the day, however this can lead to discomfort and pain over long periods. Therefore, footwear that allows a user to selectively change the heel length thereof is needed.

In light of the devices disclosed in the known art, it is submitted that the present invention substantially diverges in design elements from the known art and consequently it is clear that there is a need in the art for an improvement to existing high heel shoes. In this regard, the instant invention substantially fulfills these needs.

SUMMARY OF THE INVENTION

In view of the foregoing disadvantages inherent in the known types of high heel shoe now present in the prior art, the present invention provides a high heel shoe wherein the same can be utilized for providing convenience for the user when adjusting the length of the heel of a shoe.

The present system comprises a shoe having an upper portion extending perpendicularly upwards from a sole defining an interior volume configured to receive a foot therein. A heel having a lower side is affixed to the sole at a rear side of the shoe. The heel comprises a plurality of sections configured to telescopically move between an extended position and a retracted position. In some embodiments, a button is disposed on a front sidewall of the heel, wherein the button is affixed to a first end of an engagement member. The engagement member is configured to engage the heel when in an engaged position and to disengage the heel in a disengaged position. In another embodiment, the engagement member selectively moves between the engaged position and the disengaged position about a pivot when the button is actuated. In other embodiments, the heel is telescopic between a plurality of positions, wherein each adjacent position adjusts the distance between the lower end of the heel and the sole. In yet another embodiment, the heel is secured in a position by at least one magnet disposed within each section. In some embodiments, the heel further comprises a protrusion affixed to a second end of the engagement member wherein the protrusion is configured to engage a plurality of apertures disposed within the heel. In another embodiment, the engagement member is spring-biased such that the protrusion is engaged with the plurality of apertures. In other embodiments, a plurality of tabs extend perpendicularly outward from an outer surface of the plurality of sections at an upper end thereof. The plurality of tabs are configured to engage a plurality of slots disposed on an inner surface of the plurality of sections at a lower end thereof. In yet another embodiment, the plurality of tabs are configured to disengage from the plurality of slots when the plurality of sections are compressed. In some embodiments, the linear length of the heel is greater when the heel is in the extended position relative to the retracted position. In another embodiment, the sole comprises a high friction material. In other embodiments, the lower side comprises a high friction material.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
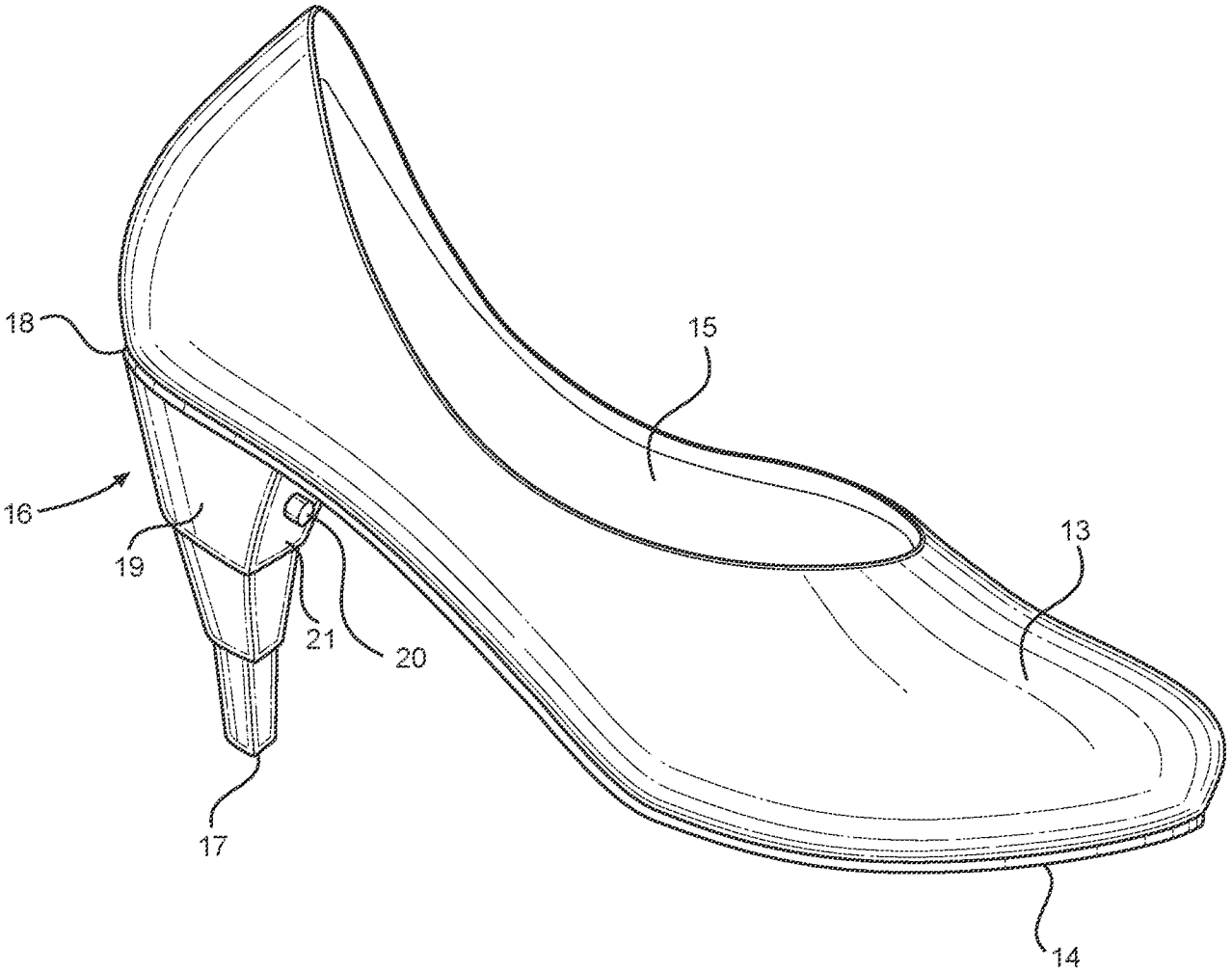
FIG. 1 shows a perspective view of an embodiment of the retractable high heel shoe in an extended position.

Reference is made herein to the attached drawings. Like reference numerals are used throughout the drawings to depict like or similar elements of the retractable high heel shoe. The figures are intended for representative purposes only and should not be considered to be limiting in any respect.

Figure 2:
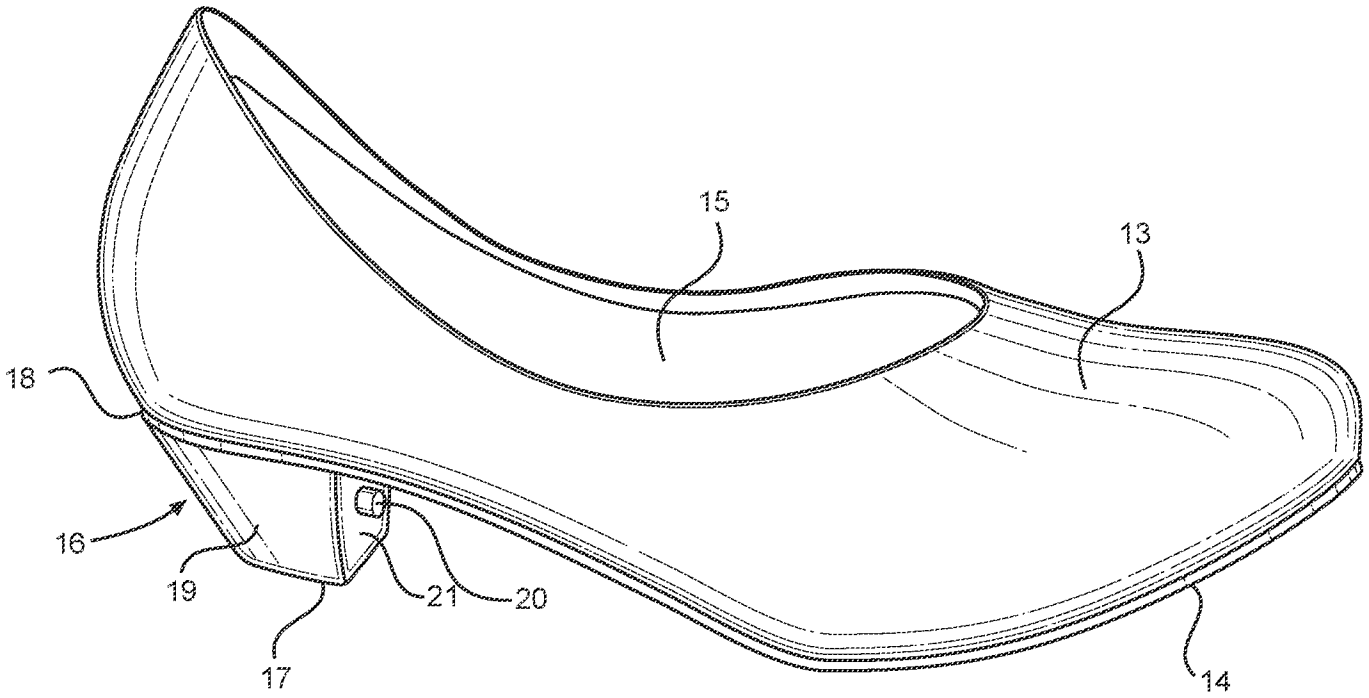
FIG. 2 shows a perspective view of an embodiment of the retractable high heel shoe in a retracted position.

Referring now to FIGS. 1 and 2, there is shown a perspective view of an embodiment of the retractable high heel shoe in an extended position and a perspective view of an embodiment of the retractable high heel shoe in a retracted position, respectively. The retractable high heel shoe comprises an upper portion 13 extending perpendicularly upwards from a sole 14 such that an interior volume 15 is formed therein. The interior volume 15 is configured to receive a foot therein, such that the retractable high heel shoe can be worn by a user. In some embodiments, the sole 14 further comprises a high friction material, such as, for example, vulcanized rubber, so as to provide a gripping surface to the retractable high heel shoe. In one embodiment, the high friction material has a coefficient of friction greater than one in order to prevent slipping.

The retractable high heel shoe further comprises a heel 16 disposed on a rear side 18 of the sole 14. The heel 16 further comprises a lower side 17 configured to engage a surface, such as a floor or the ground. In some embodiments, the lower side 17 further comprises a high friction material to provide a gripping surface to the retractable high heel shoe. In some embodiments, the high friction material has a coefficient of friction greater than one in order to prevent slipping. A button 20 is disposed on a front sidewall 21 of the plurality of sections 19. In this way, the button 20 is unlikely to be accidentally actuated. The button 20 is configured to allow the heel 16 to move between an extended position, as shown in FIG. 1, and a retracted position, as shown in FIG. 2, when the button 20 is actuated. In some embodiments, the button 20 toggles between an actuated and unactuated position, such that the button 20 rests flush against the front sidewall 21 in the actuated position. In this way, the button 20 is hidden from view to increase aesthetic appeal. The linear length of the heel 16 is greater when the heel 16 is in the extended position than when the heel 16 is in the retracted position.

The heel 16 comprises a plurality of sections 19 configured to telescopically move between the extended position and the retracted position. In this way, the heel 16 is adjustable in length. In the illustrated embodiment, the heel 16 comprises three sections 19, however in alternate embodiments, the heel 16 comprises greater or fewer sections 19 allowing a user to adjust the length of the heel 16 between a plurality of positions, wherein each adjacent position adjusts the distance between the sole 14 and the lower side 17.

Figure 3:
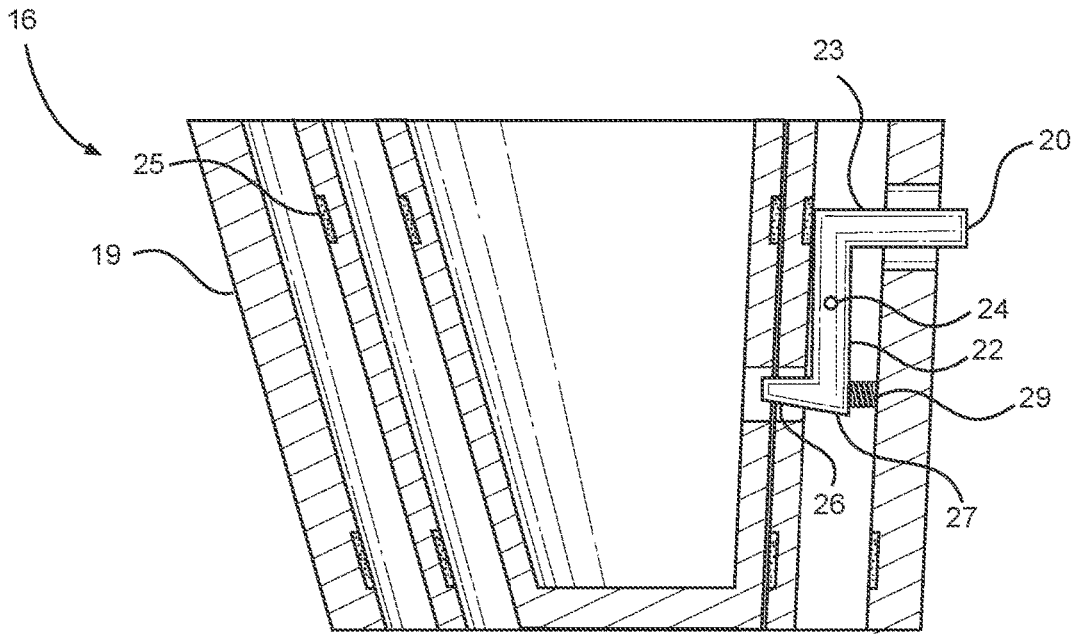
FIG. 3 shows a cross-sectional view of an embodiment of the engagement member in the engaged position.
Figure 4:
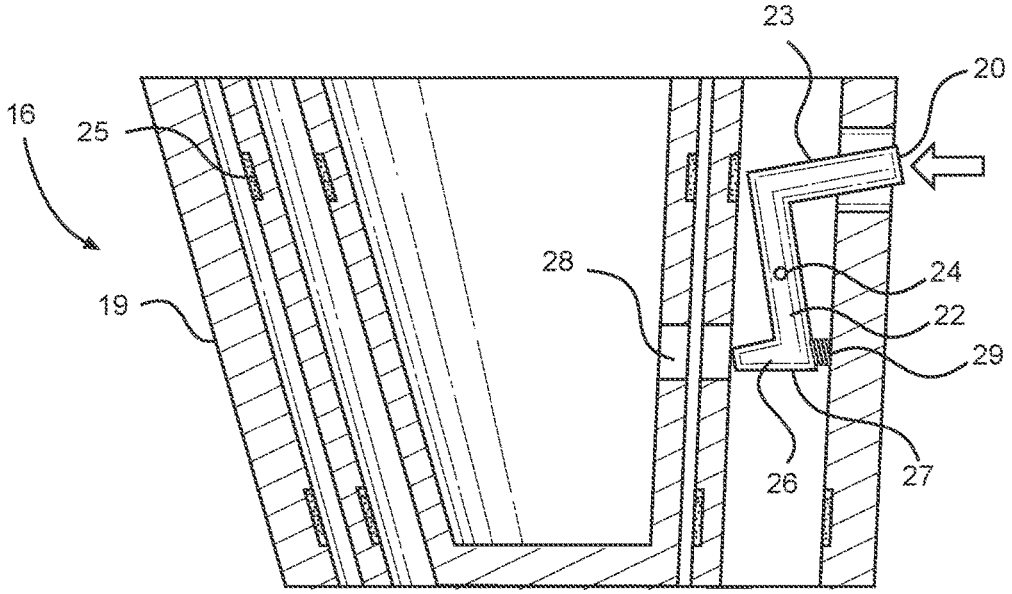
FIG. 4 shows a cross-sectional view of an embodiment of the engagement member in the disengaged position.

Referring now to FIGS. 3 and 4, there is shown a cross-sectional view of an embodiment of the engagement member in the engaged position and a cross-sectional view of an embodiment of the engagement member in the disengaged position, respectively. In the illustrated embodiment, the heel 16 further comprises an engagement member 22 disposed therein. The engagement member 22 comprises a first end 23 and a second end 27. In the illustrated embodiment, a button is disposed on the first end 23, and a protrusion 26 is disposed on the second end 27. The protrusion 26 is configured to engage a plurality of apertures 28 disposed within the plurality of sections 19. The engagement member 22 is configured to selectively move between an engaged position and a disengaged position about a pivot 24 when the button 20 is actuated. In the illustrated embodiment of FIG. 3, the engagement member 22 is in the engaged position, wherein the second end 27 is engaged with the plurality of sections 19. In this way, the plurality of sections 19 are secured in the retracted position. In the illustrated embodiment of FIG. 4, the second end 27 is disengaged from the plurality of sections 19, such that the plurality of sections 19 can telescopically move to the extended position as shown.

In the illustrated embodiment, the engagement member 22 further comprises a spring 29 biasing the engagement member 22 to the engaged position. When the button 20 is actuated, the spring 29 is compressed, disengaging the engagement member 22 from the plurality of sections 19. In the illustrated embodiment, each of the plurality of sections 19 further comprise at least one magnet 25 disposed thereon. The magnets 25 are configured to magnetically engage an opposing magnet 25 when the plurality of sections 19 are in the extended position, as shown in FIG. 4. In this way, the plurality of sections 19 are secured in the extended position, such that the heel 16 can support the weight of a user.

Figure 6:
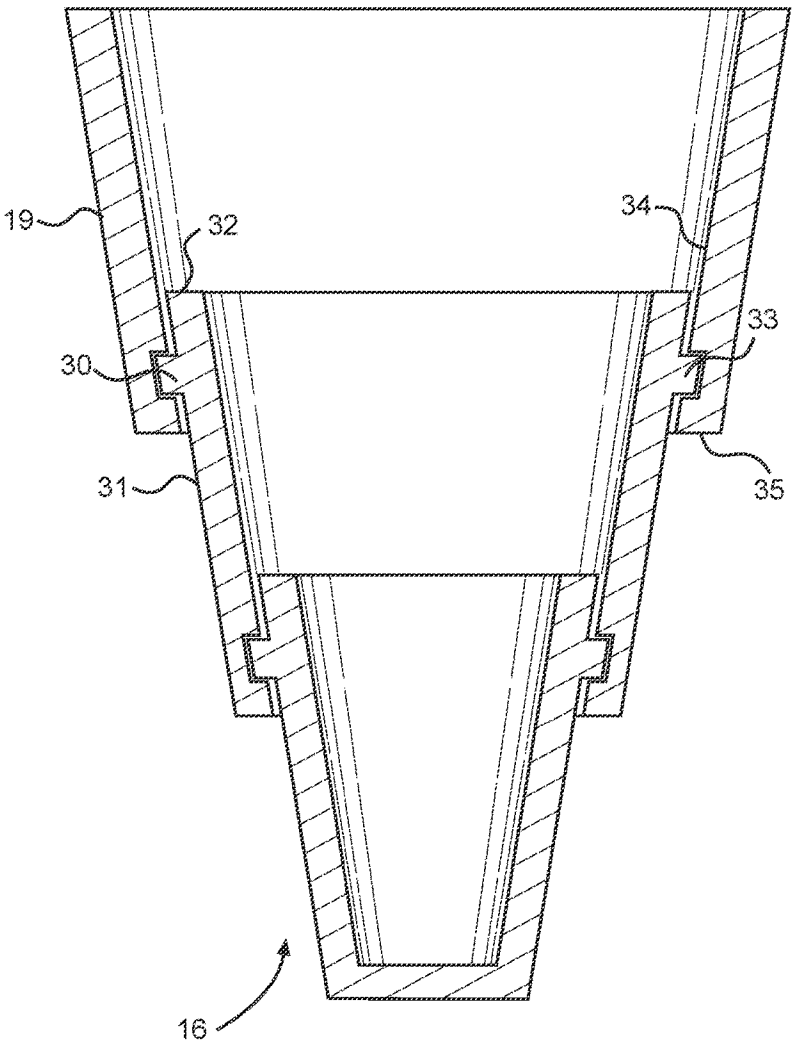
FIG. 6 shows a cross-sectional view of an embodiment of the heel having a plurality of tabs engaging a plurality of slots.
Figure 5:
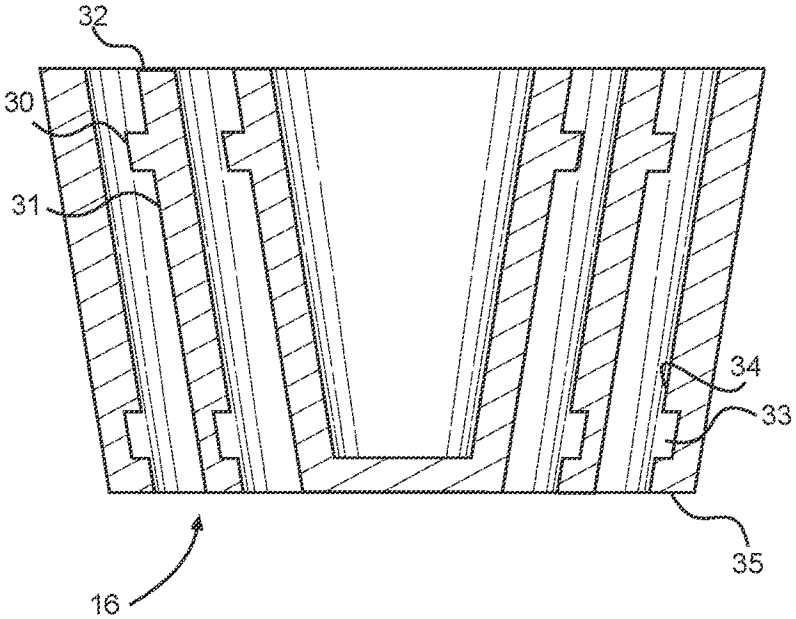
FIG. 5 shows a cross-sectional view of an embodiment of the heel having a plurality of tabs and a plurality of slots.

Referring now to FIGS. 5 and 6, there is shown a cross-sectional view of an embodiment of the heel having a plurality of tabs and a plurality of slots and a cross-sectional view of an embodiment of the heel having a plurality of tabs engaging a plurality of slots, respectively. In the illustrated embodiment, the plurality of sections 19 further comprise a plurality of tabs 30 disposed on an outer surface 31 thereof. The plurality of tabs 30 are disposed at an upper end 32 of the plurality of sections 19. The plurality of tabs 30 are configured to engage with a plurality of slots 33 disposed on an inner surface 34 of the plurality of sections 19. The plurality of slots 33 are disposed on a lower end of the plurality of sections 19. In this way, as the plurality of sections 19 extend towards the extended position, the plurality of tabs 30 engage with the plurality of slots 33 thereby securing the plurality of sections 19 in the extended position, such that the extended heel 16 can support the weight of a user. In some embodiments, the plurality of sections 19 are compressible, such that the plurality of sections 19 are under tension when in the retracted position. In this way, the plurality of tabs 30 automatically engage the plurality of slots 33 when the plurality of sections 19 are extended. In some embodiments, the plurality of tabs 30 can be disengaged from the plurality of slots 33 by compressing the plurality of sections 19. In this way, the plurality of sections 19 can be telescopically moved to the retracted position.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable high heel shoe, comprising:

a shoe having an upper portion extending perpendicularly upwards from a sole defining an interior volume configured to receive a foot therein;

a heel having a lower side affixed to the sole at a rear side of the shoe;

wherein the heel comprises a plurality of sections;

the plurality of sections in a telescopic configuration;

the plurality of sections configured to move between an extended position and a retracted position;

a button disposed on a front sidewall of the heel, wherein the button is affixed to a first end of an engagement member, the engagement member engaging the heel when in an engaged position and disengaging the heel when in a disengaged position.

2. The retractable high heel shoe of claim 1, wherein the engagement member is selectively moveable between the engaged position and the disengaged position about a pivot when the button is actuated.

3. The retractable high heel shoe of claim 1, wherein the heel is telescopic such that it can extend and retract between a plurality of positions, wherein each adjacent position adjusts a distance between the lower side of the heel and the sole.

4. The retractable high heel shoe of claim 1, wherein the position of the heel is maintained by at least one magnet disposed within each of the plurality of sections.

5. The retractable high heel shoe of claim 1, wherein the engagement member further comprises a protrusion affixed to a second end of the engagement member, wherein the protrusion engages a plurality of apertures disposed within the heel.

6. The retractable high heel shoe of claim 5, further comprising a spring configured to bias the engagement member such that the protrusion is engaged with an aperture of the plurality of apertures.

7. The retractable high heel shoe of claim 1, further comprising a plurality of tabs, each tab of the plurality of tabs extending perpendicularly outward from an outer surface of the plurality of sections at an upper end thereof, wherein the plurality of tabs engage a plurality of slots disposed on an inner surface of the plurality of sections at a lower end thereof.

8. The retractable high heel shoe of claim 7, wherein the plurality of tabs disengage from the plurality of slots when the plurality of sections are compressed.

9. The retractable high heel shoe of claim 1, wherein a linear length of the heel is greater when the heel is in the extended position relative to the retracted position.

10. The retractable high heel shoe of claim 1, wherein the sole comprises a high friction material.

11. The retractable high heel shoe of claim 1, wherein the lower side comprises a high friction material.

12. The retractable high heel shoe of claim 10, wherein the high friction material of the sole has a coefficient of friction greater than one.

13. The retractable high heel shoe of claim 11, wherein the high friction material of the lower side has a coefficient of friction greater than one.

14. A retractable high heel shoe, comprising:

a shoe having an upper portion extending perpendicularly upwards from a sole defining an interior volume configured to receive a foot therein;

a heel having a lower side affixed to the sole at a rear side of the shoe;

wherein the heel comprises a plurality of sections;

the plurality of sections in a telescopic configuration;

wherein each section of the plurality of sections defines a taper, wherein each taper is of an identical degree;

the plurality of sections configured to move between an extended position and a retracted position;

a button disposed on a front sidewall of the heel, wherein the button is affixed to a first end of an engagement member, the engagement member engaging the heel when in an engaged position and disengaging the heel when in a disengaged position the engagement member comprising a protrusion affixed to a second end of the engagement member, wherein the protrusion engages a plurality of apertures disposed within the heel.

15. A retractable high heel shoe, comprising:

a shoe having an upper portion extending perpendicularly upwards from a sole defining an interior volume configured to receive a foot therein;

a heel having a lower side affixed to the sole at a rear side of the shoe;

wherein the heel comprises a plurality of sections;

the plurality of sections in a telescopic configuration;

the plurality of sections configured to move between an extended position and a retracted position;

the plurality of sections comprising one static section affixed to the heel and at least two dynamic sections retractable therein, such that the plurality of sections are movable between at least three positions;

a button disposed on a front sidewall of the heel, wherein the button is affixed to a first end of an engagement member, the engagement member engaging the heel when in an engaged position and disengaging the heel when in a disengaged position the engagement member comprising a protrusion affixed to a second end of the engagement member, wherein the protrusion engages a plurality of apertures disposed within the heel.

* * * * *